US012415121B1

(12) United States Patent
Mitchum, Jr.

(10) Patent No.: US 12,415,121 B1
(45) Date of Patent: Sep. 16, 2025

(54) FILLABLE AND REFILLABLE MULTI-FUNCTIONAL GOLF TEE

(71) Applicant: Charles Dwight Mitchum, Jr., Virginia Beach, VA (US)

(72) Inventor: Charles Dwight Mitchum, Jr., Virginia Beach, VA (US)

( * ) Notice: Subject to any disclaimer, the term of this patent is extended or adjusted under 35 U.S.C. 154(b) by 0 days.

(21) Appl. No.: 18/898,028

(22) Filed: Sep. 26, 2024

(51) Int. Cl.
*A63B 57/10* (2015.01)
*A63B 57/20* (2015.01)

(52) U.S. Cl.
CPC ..... *A63B 57/10* (2015.10); *A63B 57/207* (2015.10)

(58) Field of Classification Search
CPC ..... A63B 57/10; A63B 57/15; A63B 2209/08; A63B 57/207
See application file for complete search history.

(56) References Cited

U.S. PATENT DOCUMENTS 1,730,046 A * 10/1929 Stow ..... A63B 57/18 401/95
1,959,347 A * 5/1934 Czichos ..... A63B 57/10 473/401
2,723,126 A * 11/1955 Spluvak ..... A63B 57/10 473/401
3,099,452 A * 7/1963 Fernicola ..... A63B 69/3655 D7/901
D268,008 S * 2/1983 Witt, Jr. ..... D7/901
4,516,780 A * 5/1985 Tabet ..... A63B 57/13 473/398
4,610,451 A * 9/1986 Keys ..... A63B 57/12 473/396
D301,003 S * 5/1989 Burns ..... D7/515
4,893,818 A * 1/1990 Liccardello ..... A63B 57/10 473/402
4,948,130 A * 8/1990 Rydborn ..... A63B 57/10 473/391
D311,431 S * 10/1990 Weber ..... D34/4
D341,745 S * 11/1993 Mitchell ..... D7/300
5,571,054 A * 11/1996 Chantal ..... A63B 57/10 473/387

(Continued)

FOREIGN PATENT DOCUMENTS

CA 2767025 A1 * 8/2013 ..... A63B 57/0037
DE 29908269 U1 12/1999

OTHER PUBLICATIONS

Definition of solid from google. < www.google.com/search?q=solid+definition&sca_esv>, retrieved on Apr. 11, 2025, pp. 1. (Year: 2025).*

*Primary Examiner* — Steven B Wong

(57) ABSTRACT

A functional golf tee comprising a prefilled, filled and/or refillable hollow tee stem having a top and a bottom. The functional golf tee also includes a removable cap mechanically connected to the top of the tee stem. The bottom of the tee stem comprises a pointed and/or pointed and threaded tip. The bottom of the tee stem may be permanent or removable. The cap is configured to retain a beverage ranging from ⅛ oz to 3 liquid ounces within the hollow tee stem. The top of the hollow tee stem and the cap are each configured to accept a golf ball for teeing. The functional golf tee with the connected cap is USGA compliant and configured to both retain a beverage or other consumable as well as accept a golf ball for teeing. As a novelty tee the functional golf tee may be non-compliant with USGA regulations.

26 Claims, 8 Drawing Sheets

(56) References Cited

U.S. PATENT DOCUMENTS

| | | | | |
|---|---|---|---|---|
| 5,690,563 | A | 11/1997 | Gammon | |
| 5,890,976 | A * | 4/1999 | Anderson | A63B 57/15 473/401 |
| 6,186,907 | B1 * | 2/2001 | Woodward | A63B 57/13 473/400 |
| 6,224,501 | B1 * | 5/2001 | Rudduck | B43K 29/00 473/401 |
| 6,682,443 | B1 * | 1/2004 | Liu | A63B 57/10 473/387 |
| 6,692,383 | B1 * | 2/2004 | Heron | A63B 57/13 473/400 |
| 6,811,499 | B1 * | 11/2004 | Hsien | A63B 57/10 473/396 |
| 6,960,143 | B2 | 11/2005 | Sato | |
| 7,086,972 | B2 * | 8/2006 | Bainbridge | A63B 57/15 473/396 |
| 7,607,998 | B1 * | 10/2009 | Park | A63B 57/15 473/387 |
| 9,914,031 | B2 | 3/2018 | Vrhel et al. | |
| 10,518,147 | B2 * | 12/2019 | Kellam | A63B 69/3617 |
| D1,022,091 | S * | 4/2024 | Wiser | D21/717 |
| D1,036,587 | S * | 7/2024 | Aronson | D21/717 |
| 12,075,932 | B1 * | 9/2024 | Sharpnack | B67C 11/02 |
| 2003/0181262 | A1 * | 9/2003 | Lee | A63B 57/13 473/396 |
| 2005/0085319 | A1 * | 4/2005 | Eckert | A63B 57/10 473/399 |
| 2006/0009312 | A1 * | 1/2006 | Chotos | A63B 57/10 473/387 |
| 2006/0100039 | A1 * | 5/2006 | Hayton | A63B 57/15 473/396 |
| 2006/0264272 | A1 | 11/2006 | Calderon | |
| 2007/0249433 | A1 | 10/2007 | Desmit | |
| 2008/0167143 | A1 | 7/2008 | Werner | |
| 2009/0111615 | A1 * | 4/2009 | Prickett | A63B 57/50 473/387 |
| 2011/0256963 | A1 * | 10/2011 | Goodwin, III | A63B 57/10 472/56 |
| 2013/0310200 | A1 * | 11/2013 | Nelson | A63B 57/10 473/401 |
| 2022/0315756 | A1 * | 10/2022 | Yang | B29B 9/16 |
| 2022/0323838 | A1 * | 10/2022 | Chavez | A63B 69/3661 |
| 2022/0339508 | A1 * | 10/2022 | Spriegel | A63B 57/10 |
| 2024/0034876 | A1 * | 2/2024 | Leon | C08L 67/04 |
| 2024/0075361 | A1 | 3/2024 | Osborne et al. | |

* cited by examiner

FILLABLE AND REFILLABLE MULTI-FUNCTIONAL GOLF TEE

TECHNICAL FIELD

The present disclosure is directed generally to the field of golf equipment design and functionality.

BACKGROUND

The game of golf has been a popular sport for centuries, with its origins dating back to the 15th century in Scotland. Over the years, the sport has seen numerous advancements and innovations, both in terms of the equipment used and the techniques employed. One of the key pieces of equipment in the game of golf is the golf tee, a small peg that is used to elevate the golf ball off the ground for the initial stroke of each hole.

Under USGA Rule 6.2, a tee is a device designed to raise the ball off the ground. It must not: be longer than 4 inches (101.6 mm); be designed or manufactured in such a way that it could indicate line of play; unduly influence the movement of the ball; or otherwise assist the player in making a stroke or in his play.

In golf, a tee is normally used for the first stroke of each hole. A standard golf tee is 2.125 inches (two and one eighth inches=5.4 cm) long, but both longer and shorter tees are permitted. Ordinary tees can be made from wood, durable plastic, bamboo, and rubber There are also many biodegradable and recyclable golf tees.

Traditional golf tees are typically made of wood or plastic. These tees often break or become damaged after just a few uses, leading to a significant amount of waste. In addition, traditional tees do not offer any additional functionality beyond their basic role of supporting the golf ball.

In recent years, there has been a growing interest in developing golf tees that offer additional features and benefits. For example, some tees have been designed to reduce friction between the tee and the ball, thereby increasing the distance the ball can travel. Others have been designed to be more durable and long-lasting, reducing the amount of waste generated.

Novelty tees are also available. They include golf tees designed specifically for shot gunning right off your tee shot beer bottle golf tees. There are also golf tees with unique tip design and tees that are threaded. One such novelty tee is a device to puncture a beer can for shooting the beer. This device is not intended as a beer or liquid receptacle nor can liquid pass through the teeing device. Another novelty tee is a plastic ball that liquid can be consumed from and contains premixed beverages and are containerized for consumption. The ball/vessel is not for use—it is a receptacle only. Yet other novelty tees are a solid tee shaped like a beer bottle. They are not refillable and cannot contain a beverage.

Despite these advancements, there remains a need for a golf tee that offers a unique combination of features and benefits. The present invention seeks to address this need.

SUMMARY

A functional golf tee comprising a pre-filled and/or refillable hollow tee stem having a top and a bottom. The functional golf tee also includes a removable cap mechanically connected to the top of the tee stem. The bottom of the tee stem comprises a pointed and/or pointed and threaded tip tee stem. The bottom of the tee stem may be permanent or removable. The functional golf tee is configured to retain a beverage ranging from ⅛ oz to 3 liquid ounces within the hollow tee stem. The cap is also configured to accept a golf ball for teeing. The top of the hollow tee stem is also configured to accept a golf ball for teeing when the cap is removed. The functional golf tee with the connected cap is USGA compliant and configured to retain both retaining a beverage and accepting a golf ball for teeing. For novelty purposes the tee may be configured in non-USGA complying dimensions.

BRIEF DESCRIPTION OF DRAWINGS

These and other aspects will now be described with reference to the following drawings in which.

DETAILED DESCRIPTION

Figure 1A:
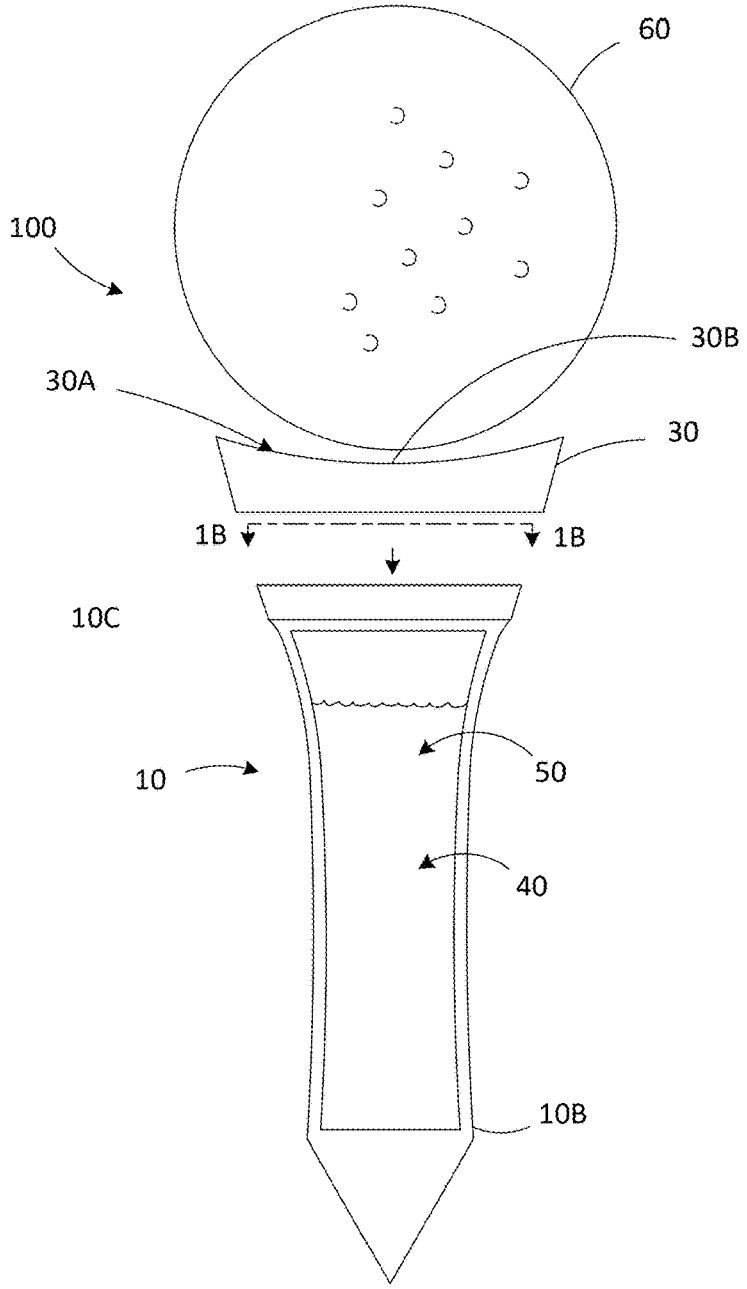
FIG. 1A shows a side view embodiment of a functional golf tee with a hollow center an open proximal end configured to be mechanically connected to a removable cap and a closed distal end.

FIG. 1A shows a functional golf tee, designed to conform to USGA specifications. This golf tee is unique in that it not only serves as a tee but also contains a volume of beverage for consumption.

Figure 1B:
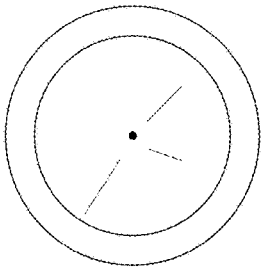
FIG. 1B shows a top view of the hollow tee stem.

The functional golf tee 100 shown in FIG. 1A comprises a hollow tee stem 10, which can be pre-filled, filled and/or refilled (hereafter "filled") by a manufacturer, bottler, or user with a beverage 50 of choice. The tee stem 10 is characterized by a hollow center 40, an open proximal end 10A configured to be mechanically connected to a removable cap 30 and a closed distal end 10B terminating in a pointed tip 20, like a standard golf tee. This design facilitates easy insertion of the tee into the ground, regardless of whether the turf conditions are wet or dry. FIG. 1B shows a top view of the hollow tee stem 10.

In one embodiment, the cap 30 can be unscrewed by cap screw threads 30A and corresponding screw tee stem threads 10C (depicted in detail at least by FIGS. 2A and 4) on the open proximal end 10A of the tee stem 10 to allow for the consumption of the beverage 50 contained within the hollow center 40 of the tee stem 10. After consumption of the liquid beverage 50, the cap 30 can be reattached and used to tee a golf ball from off the cap 30. In the depicted embodiment, the removable cap 30 has a beveled or depressed portion 30B at the center of the cap 30 to hold a golf ball 60. In one embodiment, the open proximal end of 10A of the tee stem 10 may have a beveled or depressed portion 10D at the center of the tee stem 10 to hold a golf ball 60.

Figure 2A:
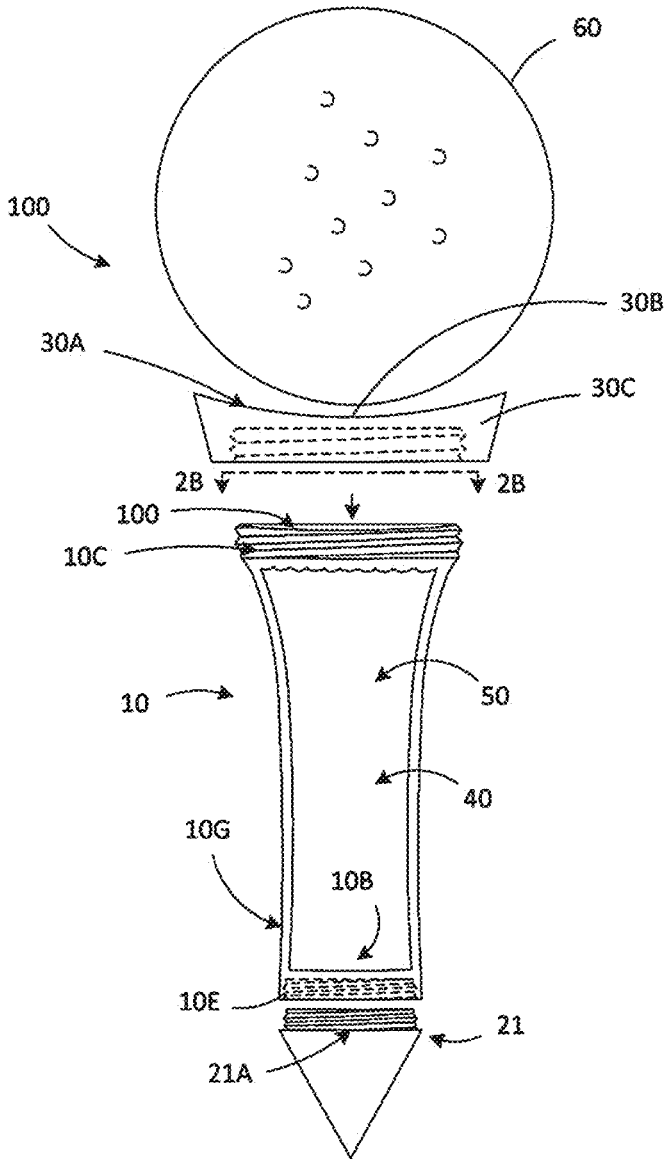
FIG. 2A shows a top view of a functional golf tee with a hollow center, an open proximal end configured to be mechanically connected to a removable cap and an open distal end.
Figure 2B:
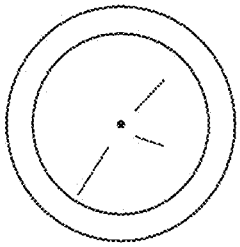
FIG. 2B shows a top view of the hollow tee stem 10.

FIG. 2A shows a side view embodiment of a functional golf tee with a hollow center, an open proximal end configured to be mechanically connected to a removable cap and an open distal end. FIG. 2B shows a top view of the hollow tee stem 10.

In one embodiment, the tee stem 10 is characterized by a hollow center 40, an open proximal end 10A configured to be mechanically connected to a removable cap 30 and an open distal end 10B configured to be mechanically connected to a removable tip 21. In one embodiment, the removable tip 21 can be unscrewed by tip screw threads 21A and corresponding tee stem distal end screw threads 10E located on the open distal end 10B of the tee stem 10 to allow for disassembly and cleaning of the tee stem 10.

In one embodiment, the removable tip 21 with tip screw threads 21A allows for an adjustable height of the functional golf tee 100. In one embodiment, the removable tip 21 terminates in a pointed tip 21B, like a standard golf tee. This design facilitates easy insertion of the tee into the ground, regardless of whether the turf conditions are wet or dry.

Figure 3A:
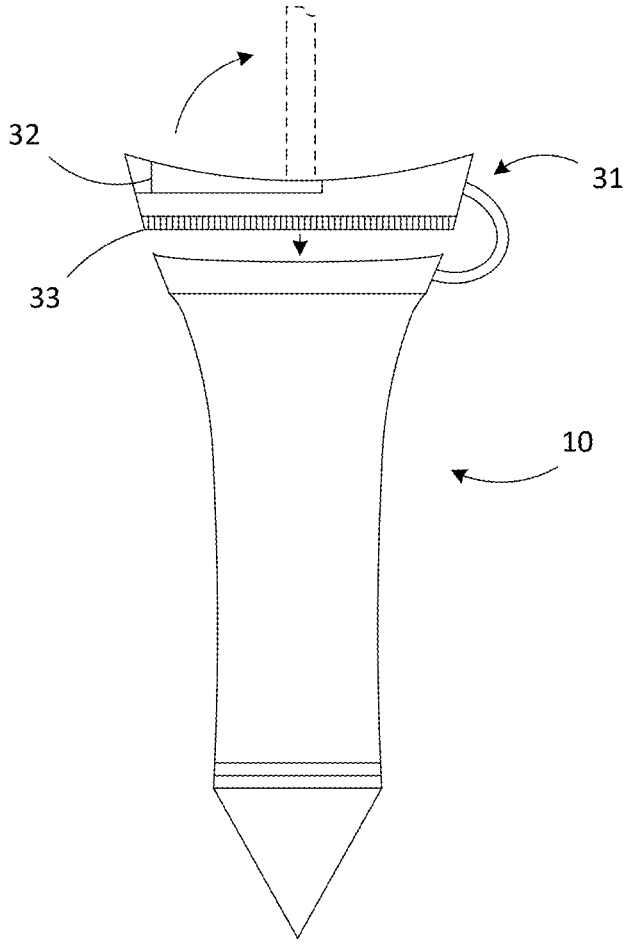
FIG. 3A shows a functional golf tee with a flip-top or pop-top cap.

FIG. 3A shows a functional golf tee 100 with a flip-top or pop-top cap 31. This mechanism features a user-friendly mechanism that allows for easy opening and closing with a simple push or pull action. In one embodiment, the pop-top cap 31 is made of a durable material such as plastic or metal to ensure longevity and repeated use.

For example, a golf enthusiast may use the device with a pop-top cap 31 to conveniently carry their favorite energy drink on the course. The pop-top cap 31 allows for quick access to the beverage between holes without the need to unscrew a screw cap 30, saving time and effort during gameplay.

Alternatively, the pop-top cap 31 and/or the screw cap 30 may be designed with a built-in collapsible straw 32 for sipping the beverage directly from the tee stem. This feature adds convenience for users who prefer to drink their beverage without having to remove the cap 30 entirely.

In another embodiment, the pop-top cap 31 may include a small compartment (not shown) for storing sugar packets, drink mixes, or other additives to customize the beverage on the go. This compartment is securely attached to the pop-top cap 31 and can be easily accessed when needed. This feature adds a layer of practicality and ease of use, making the device suitable for on-the-go consumption.

For example, the tab on the pop-top cap 31 could be ergonomically designed for easy opening and closing. It may also feature a textured surface or a non-slip grip to facilitate handling, especially in outdoor or sports activities where a firm grip is essential.

In the device as described above, the removable cap 30 may be a pop-top. The pop-top cap can be easily removed by applying a slight amount of pressure, allowing for convenient access to the beverage. For example, the pop-top cap may feature a spring-loaded mechanism that pops open the cap when a button is pressed. This design ensures that the cap stays closed during normal handling but can be effortlessly opened when needed.

In one embodiment the removable cap 30 may have a silicon or rubber gasket or seal 33 to add an extra layer of protection against accidental spills of the beverage 50, preventing any air from entering the tee stem and maintaining the freshness of the beverage for an extended period. The gasket 33 ensures that the beverage remains at its optimal quality, ready to be enjoyed at any time.

Figure 3B:
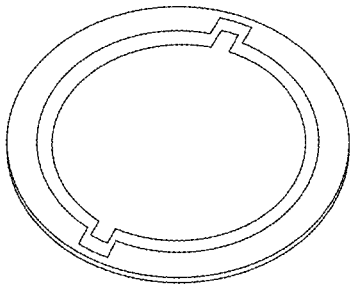
FIG. 3B shows the removable cap with a bayonet-style connection, wherein the cap is pushed down and twisted to lock into place.

FIG. 3B shows the removable cap 30 may also take different forms such as but not limited to a bayonet-style connection 30C, where the cap 30 is pushed down and twisted to lock into place (hereafter a "bayonet cap"). This type of connection offers a quick and secure way to seal the tee stem closed, ideal for situations where the device may be jostled or moved frequently. The removable cap 30 may also take different forms known to those of ordinary skill in the art to include an elastic, plastic or rubber bottle top, or bottle cap. In each embodiment the cap 30 and the tee stem proximal end 10A are configured to hold a golf ball for teeing.

Figure 3C:
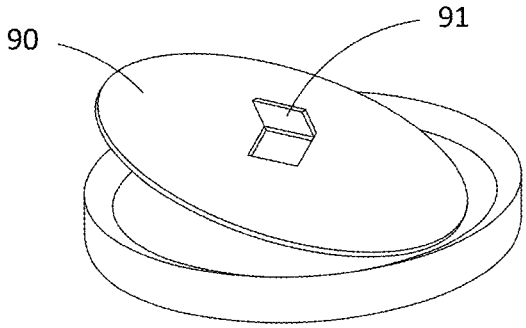
FIGS. 3C and 3D show a removable cap configured with a built-in ball marker.
Figure 3D:
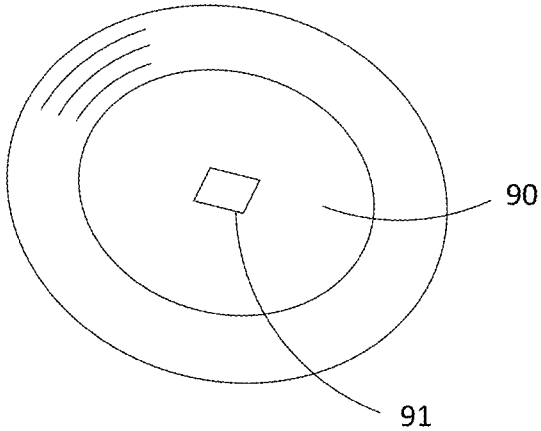

As shown in FIGS. 3C and 3D, the removable cap 30 can be configured with a built-in ball marker 90. This ball marker 90 can be easily flipped out of the cap 30 with a pull tab 91 when needed and securely tucked back into the cap 30 when not in use. This dual functionality adds convenience for golfers who want to have a drink while playing without the need for an additional ball marker.

Figure 4:
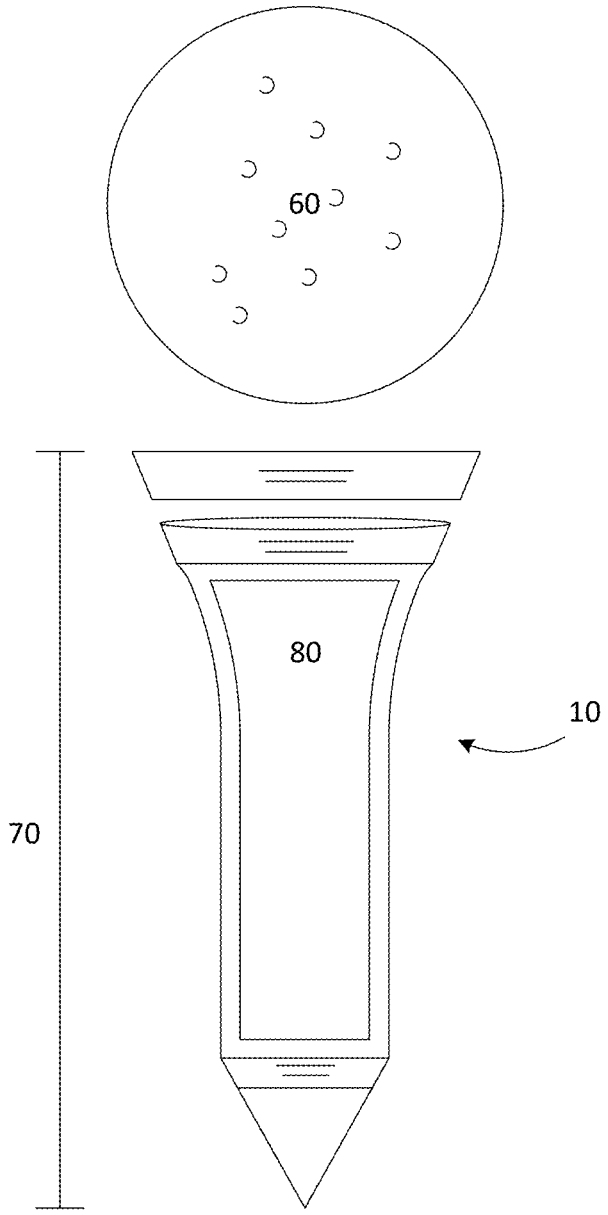
FIG. 4 shows a functional golf tee with dimensions, conforming to USGA standards.
Figure 5A:
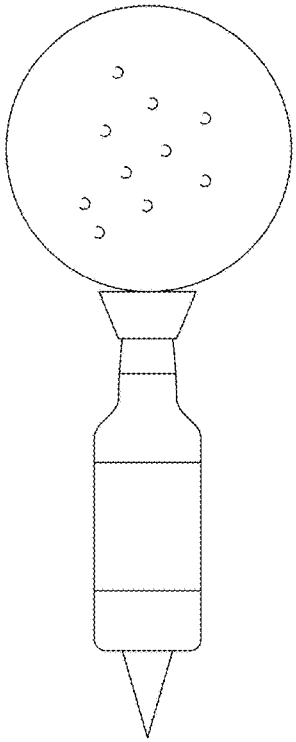
FIG. 5A-5F, shows the hollow tee stem in various shapes.
Figure 5B:
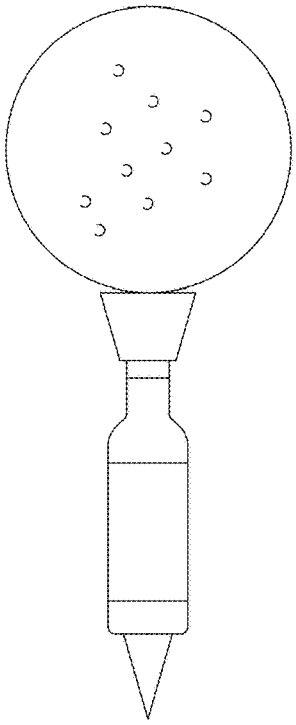
Figure 5C:
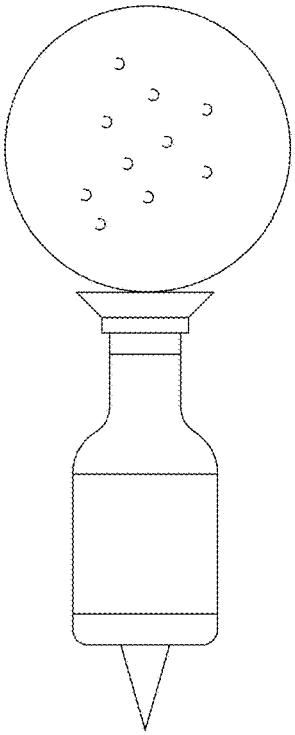
Figure 5D:
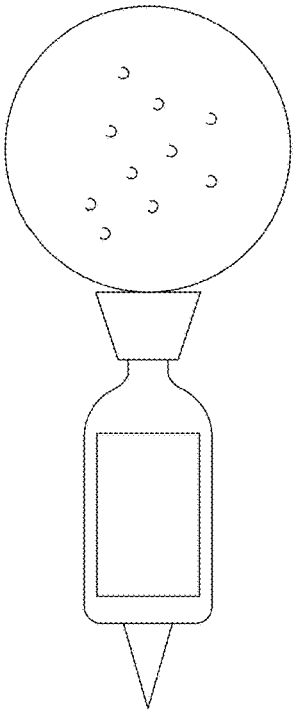
Figure 5E:
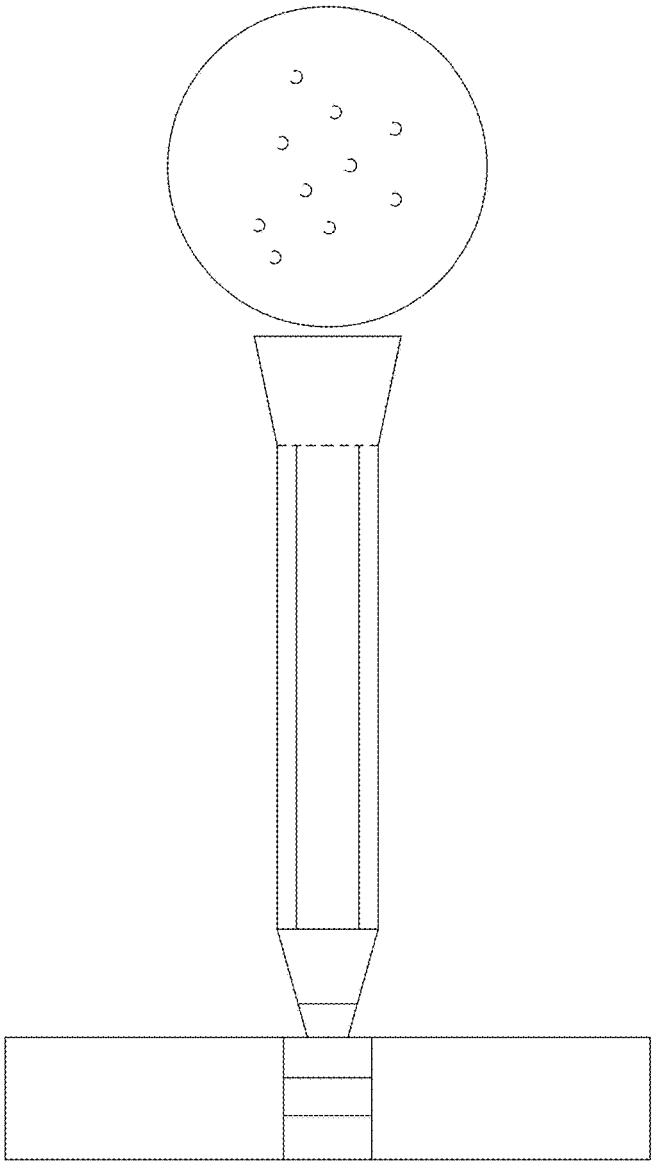
Figure 5F:
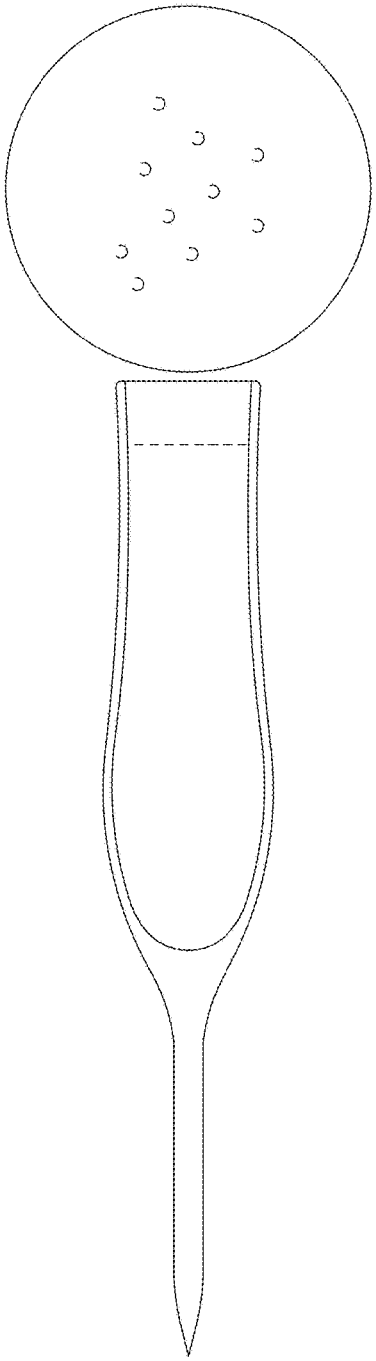

FIG. 4 shows that in terms of dimensions, the functional golf tee 100, conforms to USGA standards by not exceeding 4 inches in height 70. In one embodiment, the tee stem volume 80 of the tee stem 10 is configured to hold between ⅛ to 3 ounces of liquid. The shape of the tee stem 10 may vary to accommodate various radii and diameters for holding between ⅛ to 3 ounces of liquid while still complying with USGA standards. In another embodiment, the tee stem is configured to contain a consumable beverage ranging from ½ oz to 1½ ounces liquid volume.

As shown in FIGS. 5A-5F, the functional golf tee 100 may come in various shapes such as a hurricane glass, round shot glass, beer bottle, wine bottle, liquor bottle or standard golf tee shape, provided that it can hold sufficient ⅛ to 3 oz of beverage 50.

Alternate embodiments of this invention include designs with and without a removable tip 21. For example, the embodiments depicted by FIGS. 5A-5E include the removable tip 21. The embodiment depicted by FIG. 5F includes the pointed tip 20. In the embodiment depicted by FIG. 5F the pointed tip 20 is not removable, In each design, all components are safe for food consumption. In one embodiment the functional tee 100 is biodegradable. One embodiment allows for the use of existing bottlers to implement their own propriety design such as but not limited to those seen with "airline style" bottles, liquor bottles and/or beer bottles. In each of these designs, modifications can be made to the bottle cap 30 to secure the removable cap 30 to the tee stem 10 with a tip 20 or 21 on the bottom of the tee stem 10 for securing the tee into the turf.

In another variation, the tee stem 10 could be designed with a removable/detachable tip 21 that allows for easy cleaning and refilling of the consumable beverage. The detachable tip 21 can be secured to the tee stem 10 using a twist-lock mechanism or a snap-on design, enabling convenient disassembly for maintenance purposes.

Figure 6:
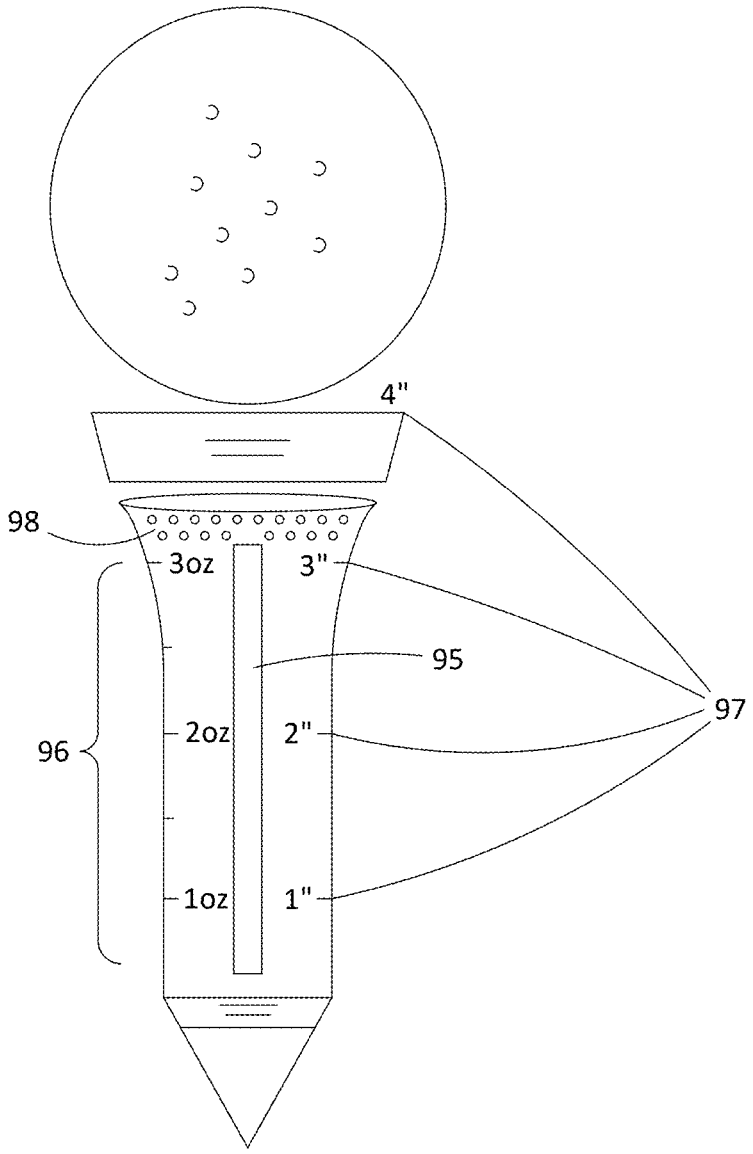
FIG. 6 shows a functional golf tee with a magnetic strip along the side of a transparent tee stem customized with markings and measurements.

As shown in FIG. 6, another innovative feature that can be incorporated into the functional golf tee is a magnetic strip 95 along the side of the tee stem 10. This magnetic strip can be used to hold metal ball markers 90 onto the tee stem 10, ensuring that golfers have easy access to their markers during the game. Additionally, the magnetic strip 95 can be used to attach other accessories such as divot tools or additional ball markers (not shown), providing a versatile solution for golfers looking to streamline their equipment on the course.

In an alternative embodiment, the refillable hollow tee stem can be made from a transparent material, allowing golfers to see the level of the beverage 50 inside the stem at all times. This transparency feature not only adds a visual appeal to the functional golf tee but also enables golfers to monitor their drink consumption during the game. Additionally, the transparent tee stem can be customized with markings or measurements 96 to help golfers track their hydration intake throughout the round.

In the device as described above, the tee stem 10 is varied dimensions but not greater than 4 inches in height with the cap in place and the tip in its most extended position. This height ensures that the golf ball is positioned at an appropriate height for the golfer to achieve the desired trajectory and distance when teeing off. Notably, in one embodiment, the device as a novelty may exceed USGA specifications.

In another variation, the tee stem 10 comprises a telescopic tip configured to allow golfers to adjust the height of the tee according to their preferences or the type of club being used. This adjustability feature provides versatility and convenience for golfers of all skill levels.

For example, a golfer using the functional golf tee can easily adjust the height of the tee stem 10 by adjusting the removable tip 21 to accommodate different club sizes and personal preferences. The height 70 of the tee stem 10 provides versatility for golfers of varying skill levels and playing styles.

Alternatively, the tee stem 10 can be designed to be adjustable using placement in the turf like a standard golf tee, allowing golfers to customize the height of the tee based on their specific needs. This adjustability feature can enhance the golfer's experience by enabling them to fine-tune their setup for optimal performance on the course.

In another variation, the tee stem 10 and cap 30 may have markings or indicators 97 at specific intervals along its length to assist golfers in consistently setting the tee at the desired height. These markings can serve as a visual guide for golfers to achieve a consistent setup for their shots, leading to improved performance and accuracy on the golf course.

For example, a golfer using the functional golf tee may choose to fill the hollow tee stem 10 with a sports drink or water to stay hydrated during a game. The transparent or translucent design of the tee stem allows the golfer to easily monitor the remaining amount of liquid inside the tee stem. The narrow neck portion enables the golfer to drink directly from the tee stem without the need for additional cups or containers.

In another variation, the tee stem 10 may have a textured surface or grip area 98 to enhance handling and prevent slippage when holding the functional golf tee. The textured surface 98 may provide a secure grip for the golfer, especially in wet or humid conditions on the golf course.

In one embodiment the tee stem 10 can be constructed with a flexible material that absorbs some of the impact energy when the club strikes the ball. This flexibility can help reduce the risk of the tee stem breaking upon impact, increasing its durability and longevity.

In another embodiment, the functional golf tee is made of a bio-degradable plastic. More specifically, it may be made of polylactide acid ("PLA") derived from renewable resources such as corn starch or sugarcane, making it an environmentally friendly option for the golf tee. The PLA material provides sufficient durability and strength to withstand the impact of a golf club striking the ball while also being biodegradable, reducing environmental impact.

An alternative material that can be used for the functional golf tee is a composite material comprising a mixture of biodegradable plastics and natural fibers such as bamboo or hemp. This composite material offers a balance between strength, durability, and eco-friendliness, making it a suitable choice for environmentally conscious golfers.

Furthermore, the bio-degradable plastic used in the functional golf tee can be colored or tinted using natural dyes or pigments. This allows for customization options, enabling golfers to choose from a variety of colors for their golf tees. The natural dyes or pigments may be non-toxic and do not compromise the biodegradability of the material, ensuring that the functional golf tee remains environmentally friendly.

In another embodiment, the bio-degradable plastic used in the functional golf tee is infused with UV inhibitors. The UV inhibitors help protect the golf tee and its contents from degradation caused by exposure to sunlight, extending the lifespan of the tee while maintaining its biodegradable properties. This feature is particularly beneficial for golfers who play frequently in sunny conditions, ensuring that the functional golf tee remains intact throughout multiple rounds of golf.

In another embodiment, the bio-degradable plastic used in the functional golf tee 100 is waterproof. The waterproof materials help protect the golf tee from degradation caused by exposure to rain, dew or water hazards, extending the lifespan of the tee while maintaining its biodegradable properties. This feature is particularly beneficial for golfers who play frequently in rainy conditions, ensuring that the functional golf tee remains intact throughout multiple rounds of golf.

In another embodiment, the tee stem is made with insulating materials to keep the beverage at the desired temperature for an extended period. Insulating materials are well-known to those of ordinary skill in the art and may include materials such as but not limited to polyurethane foam, fiberglass, glass wool, mineral wool, aerogel, cellulose, and expanded polystyrene ("EPS"). This insulation feature would be particularly beneficial for beverages that are best enjoyed when kept hot or cold.

In one embodiment, a valve mechanism (not shown) within the cap 30 can be designed to regulate the flow of the beverage, enabling the user to pour out precise amounts as desired. For example, the valve mechanism may consist of a twistable knob or a push-button mechanism that opens and closes the flow of the beverage.

As an alternative embodiment, the tee stem 10 could be designed with interchangeable caps or nozzles to known to those of ordinary skill in the art to accommodate different types of beverages or to create varying dispensing patterns. For instance, a wider opening cap may be used for thicker beverages like smoothies, while a narrow nozzle may be preferred for pouring liquids like coffee or spirits.

In another variation, the tee stem could be designed with a detachable base proximal to the tip that allows for easy cleaning and refilling of the consumable beverage. The detachable base can be secured to the tee stem using a twist-lock mechanism or a snap-on design, enabling convenient disassembly for maintenance purposes.

The device, as described above, comprises a functional golf tee 100. The functional golf tee in the device conforms to USGA specifications. That is under USGA Rule 6.2, a tee is a device designed to raise the ball off the ground. It must not: be longer than 4 inches (101.6 mm); be designed or manufactured in such a way that it could indicate line of play; unduly influence the movement of the ball; or otherwise assist the player in making a stroke or in his play. This allows players to use the device in tournament play without any concerns about non-compliance with the rules. In another embodiment the device as a novelty tee may be configured to exceed or be non-complaint with USGA specifications.

An alternative to conforming to USGA specifications could involve customization options for the functional golf tee. For instance, players may have the choice to select different tee lengths or head diameters based on their personal preferences or playing styles. This customization feature adds a layer of personalization to the device, catering to the diverse needs of golfers.

Moreover, the tee stem itself could be made of a transparent material such as bisphenol-A ("BPA")-free plastic or glass, allowing users to easily monitor the remaining liquid volume inside. This transparency feature not only enhances the aesthetic appeal of the device but also serves a functional purpose by indicating when a refill is needed.

In another variation, the removable cap 30 could be designed with a color-coding system, where different colored caps correspond to different beverage flavors or types. This visual cue can help users quickly identify their preferred drink without the need for additional labels or markings on the device.

In the device as described above, the hollow tee stem is configured for a specific purpose. The hollow tee stem 10 is designed to hold non-liquid consumables. These non-liquid consumables may comprise cannabidiol ("CBD") oils, liquid soluble powders, candy, gum, chewables, pouches and granular gummies. The configuration of the hollow tee stem allows for the containment of these specific types of consumables.

This unique configuration of the hollow tee stem enables it to securely hold and dispense these particular types of consumables.

For instance, the hollow tee stem may feature a threaded cap at one end, allowing for easy filling and sealing of CBD oils. The cap can be unscrewed to fill the stem with the desired amount of CBD oil and then securely closed to prevent any leakage or spillage. This design ensures that the CBD oil is safely contained within the hollow tee stem until it is ready to be dispensed.

In addition to CBD oils and liquid soluble powders, the hollow tee stem can also be configured to accommodate granular gummies. The stem may include a mesh or sieve at one end to prevent the gummies from spilling out while allowing for easy dispensing. (not shown) This design ensures that the granular gummies are securely held within the stem and can be dispensed in a controlled manner. The contents may also be dispensed by removing the cap 30.

Furthermore, alternative configurations of the hollow tee stem 10 can be explored to cater to different types of consumables or to enhance the functionality of the device. For example, the stem could be divided into multiple compartments to store a variety of consumables simultaneously. This modular design (not shown) would allow users to customize the device based on their preferences and needs.

In the device as described above, the bottom of the hollow tee stem is designed to be removable. This feature allows for convenient washing as well as loading and unloading of different types of consumables, enhancing the versatility of the device. For example, a user can easily replace CBD oils with liquid soluble powders or granular gummies by simply removing the bottom of the hollow tee stem.

Furthermore, the removable bottom design facilitates cleaning and maintenance of the device. Users can easily disassemble the tee stem for thorough cleaning, ensuring hygiene and preventing cross-contamination between different types of consumables.

An alternative embodiment could include a twist-lock mechanism for the removable bottom, providing a secure closure while still allowing for easy removal when needed. This feature would add an extra layer of safety and stability to the device, particularly important for users who may carry the device while traveling or on-the-go.

Another alternative design could involve a transparent or translucent removable bottom, allowing users to easily see the remaining amount of consumables inside the tee stem. This visual indicator would help users monitor their consumable levels and plan for refills accordingly.

In the device as described above, the hollow tee stem top is configured in a specific manner. The configuration of the hollow tee stem top is such that it is capable of accepting a golf ball for teeing. Notably, this acceptance of the golf ball for teeing is achieved without the need for the removable cap.

This design feature enhances the user experience by simplifying the teeing process. For example, the hollow tee stem top may have a flexible opening that expands to accommodate the golf ball when it is pressed down, and then contracts to securely hold the ball in place.

Although the invention has been described in terms of preferred embodiments as set forth above, it should be understood that these embodiments are illustrative only and that the claims are not limited to those embodiments. It is also to be understood that the features of the functional golf tee are interchangeable regardless of the type of cap, tip or materials used. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

In summary the present device is a functional golf tee comprising a refillable hollow tee stem having a top and bottom comprising a pointed tip; and a removable cap mechanically connected to the top of the tee stem, wherein the functional golf is USGA compliant and configured to retain a beverage volume ranging from ⅛ oz to 3 liquid ounces within the hollow tee stem, and the removable cap is configured to accept a golf ball for teeing.

In one embodiment, the tee stem is not more than 4 inches in height.

In one embodiment, the tee stem is shaped as a standard golf tee.

In one embodiment, the tee stem is shaped as a bottle.

In one embodiment, the functional golf tee is made of a bio-degradable plastic.

In one embodiment, the removable cap is a screw cap.

In one embodiment, the removable cap is a bayonet cap.

In one embodiment, the removable cap is a pop-top.

In one embodiment, the pop-top cap comprises a tab permanently connected to the hollow tee stem.

In one embodiment, the removable cap comprises a built-in collapsible straw.

In one embodiment, the removable cap comprises a built-in ball marker.

In one embodiment, the built-in ball marker further comprises a pull tab.

In one embodiment, the hollow tee stem is configured to hold consumables comprising CBD oils, liquid soluble powders, candy, chewables, and granular gummies.

In one embodiment, the hollow tee stem bottom is removable.

In one embodiment, the hollow tee stem top is configured to accept a golf ball for teeing without the removable cap.

In one embodiment, the hollow tee stem comprises a textured surface.

In one embodiment, the transparent tee stem is transparent.

In one embodiment, the transparent tee stem comprises markings or measurements.

In one embodiment, the functional golf tee has a shape comprising a hurricane glass, round shot glass, beer bottle, wine bottle, liquor bottle or standard golf tee shape.

In one embodiment, the tee stem comprises a telescopic tip to adjust the height of the tee.

In one embodiment, the bio-degradable plastic is infused with UV inhibitors.

In one embodiment, the bio-degradable plastic is waterproof.

In one embodiment, the functional golf tee is made of insulating materials.

In one embodiment, the device of claim 1 further comprises a magnetic strip along the side of the tee stem.

In one embodiment, the top of the hollow tee stem is configured to accept a golf ball for teeing.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

For the sake of brevity and legibility, the present disclosure does not explicitly recite each and every permutation that may be obtained by choosing from the disclosed features. However, the present disclosure is to be interpreted as explicitly disclosing all such permutations. For example, a system described as having three possible features may be implemented in seven different ways, namely with just one of the three possible features, with any two of the three possible features or with all three of the three possible features. The disclosed features may be combined in any configuration excepting those readily apparent to the person skilled in the art as nonsensical.

Elements described herein as coupled or connected may have an effectual relationship realizable by a direct connection or indirectly with one or more other intervening elements. As used herein the phrases "connected to," "coupled to" and "in communication with" and their equivalents refer to any form of interaction between two or more entities, including mechanical, electrical, magnetic, electromagnetic, fluid, and thermal interaction. Components may be functionally coupled to each other even though they are not in direct contact with each other. The terms "abutting" or "in mechanical union" refer to items that are in direct physical contact with each other, although the items may not necessarily be attached together.

While various embodiments of the present invention have been described above, it should be understood that they have been presented by way of example only, and not of limitation. Likewise, the various diagrams may depict an example architectural or other configuration for the invention, which is provided to aid in understanding the features and functionality that can be included in the invention. The invention is not restricted to the illustrated example architectures or configurations, but the desired features can be implemented using a variety of alternative architectures and configurations.

Indeed, it will be apparent to one of skill in the art how alternative functional configurations can be implemented to implement the desired features of the present invention. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

What is claimed is:

1. A fillable and refillable functional golf tee comprising:

a single unitary hollow tee stem body having an open proximal top, an open distal bottom, and a 3-ounce hollow center volume from the open proximal top to the open distal bottom;

a solid pointed tip connected to the open distal bottom to enclose the 3-ounce hollow center volume of the hollow tee stem body, wherein the hollow tee stem body is selectively empty, filled, or partially filled with a consumable comprising water, coffee, sports drinks, energy drinks, liquid spirits, CBD oils, liquid soluble powders, candy, chewables, and granular gummies; and a removable cap connected to the open proximal top to enclose the 3-ounce hollow center at the open proximal top of the hollow tee stem body;

wherein the single unitary hollow tee stem body, the connected removable cap and the solid pointed tip is the fillable and refillable functional golf tee; and the fillable and refillable functional golf tee is not more than 4 inches in height.

2. The fillable and refillable functional golf tee of claim 1, wherein the functional golf tee is made of a bio-degradable plastic.

3. The fillable and refillable functional golf tee of claim 1, wherein the removable cap is a screw cap.

4. The fillable and refillable functional golf tee of claim 1, wherein the removable cap is a bayonet cap.

5. The fillable and refillable functional golf tee of claim 1, wherein the removable cap is a pop-top cap.

6. The fillable and refillable functional golf tee of claim 5, wherein the pop-top cap comprises a tab permanently connected to the hollow tee stem body.

7. The fillable and refillable functional golf tee of claim 1, wherein the removable cap comprises a built-in collapsible straw.

8. The fillable and refillable functional golf tee of claim 1, wherein the removable cap comprises a built-in ball marker.

9. The fillable and refillable functional golf tee of claim 8, wherein the built-in ball marker further comprises a pull tab.

10. The fillable and refillable functional golf tee of claim 1, wherein the proximal top of the hollow tee stem body is configured to accept a golf ball.

11. The fillable and refillable functional golf tee of claim 1, wherein the hollow tee stem body comprises a textured surface.

12. The fillable and refillable functional golf tee of claim 1, wherein the hollow tee stem body is transparent.

13. The fillable and refillable functional golf tee of claim 12, wherein the hollow tee stem body comprises markings or measurements.

14. The fillable and refillable functional golf tee of claim 1, wherein the functional golf tee has a shape comprising a hurricane glass, round shot glass, beer bottle, wine bottle, liquor bottle or standard golf tee shape.

15. The fillable and refillable functional golf tee of claim 2, wherein the bio-degradable plastic is infused with UV inhibitors.

16. The fillable and refillable functional golf tee of claim 2, wherein the bio-degradable plastic is waterproof.

17. The fillable and refillable functional golf tee of claim 1, wherein the functional golf tee is made of insulating materials.

18. The fillable and refillable functional golf tee of claim 1, further comprising a magnetic strip along a side of the refillable hollow tee stem.

19. The fillable and refillable functional golf tee of claim 2, wherein the proximal top of the hollow tee stem body is configured to accept a golf ball.

20. The fillable and refillable functional golf tee of claim 1, wherein the hollow tee stem body is prefilled, filled or refilled by a manufacturer, bottler, or user with a beverage or consumable.

21. The fillable and refillable functional golf tee of claim 1, wherein the removable cap is mechanically connected to the open proximal top of the hollow tee stem body.

22. The fillable and refillable functional golf tee of claim 1, wherein the fillable and refillable functional golf tee is USGA compliant.

23. The fillable and refillable functional golf tee of claim 1, wherein the hollow tee stem body is configured to hold consumables comprising water, coffee, sports drinks, energy drinks, and liquid spirits.

24. The fillable and refillable functional golf tee of claim 1, wherein the consumable is of a volume from 1.5 ounces to 3.0 ounces.

25. The fillable and refillable functional golf tee of claim 11, wherein the hollow tee stem body comprises a non-textured surface.

26. The fillable and refillable functional golf tee of claim 1, wherein the solid pointed tip is mechanically connected to the open distal bottom of the hollow tee stem body.

* * * * *